US012331670B2

(12) United States Patent
Birsen et al.

(10) Patent No.: US 12,331,670 B2
(45) Date of Patent: Jun. 17, 2025

(54) ANTI-THEFT COVERING SYSTEM FOR CATALYTIC CONVERTERS

(71) Applicants: Thomas J. Birsen, Waterville, OH (US); David Birsen, Waterville, OH (US)

(72) Inventors: Thomas J. Birsen, Waterville, OH (US); David Birsen, Waterville, OH (US)

( * ) Notice: Subject to any disclaimer, the term of this patent is extended or adjusted under 35 U.S.C. 154(b) by 55 days.

(21) Appl. No.: 18/129,276

(22) Filed: Mar. 31, 2023

(65) Prior Publication Data

US 2024/0052768 A1 Feb. 15, 2024

Related U.S. Application Data

(60) Provisional application No. 63/329,397, filed on Apr. 9, 2022.

(51) Int. Cl.
*F01N 13/18* (2010.01)

(52) U.S. Cl.
CPC ..... *F01N 13/1805* (2013.01); *F01N 2260/22* (2013.01)

(58) Field of Classification Search
CPC ..... F01N 2260/22
See application file for complete search history.

(56) References Cited

U.S. PATENT DOCUMENTS 5,343,895 A * 9/1994 King ..... F16L 11/085 138/125
11,708,783 B1 * 7/2023 Corkery ..... F01N 13/1888 248/551
2003/0188793 A1 * 10/2003 Kanbe ..... F16L 11/125 138/137
2004/0093918 A1 * 5/2004 Leyden ..... B62H 3/00 70/234
2008/0063875 A1 * 3/2008 Robinson ..... B32B 17/02 428/446
2010/0317545 A1 * 12/2010 McNamara ..... C09J 163/00 506/13
2017/0350049 A1 * 12/2017 Shirotani ..... D04H 3/009
2021/0253062 A1 * 8/2021 Tamagni ..... F01N 13/18
2021/0292491 A1 * 9/2021 Ouchiyama ..... C08J 5/243

FOREIGN PATENT DOCUMENTS

JP 3941102 B2 * 7/2007 ..... B32B 1/08
JP 4346800 B2 * 10/2009
JP 2015086574 A * 5/2015

OTHER PUBLICATIONS

English Translation of JP 201586574 A (Year: 2015).*
English Translation JP-3941102-B2 (Year: 2007).*
English Translation of JP-4346800-B2 (Year: 2009).*

* cited by examiner

*Primary Examiner* — Anthony Ayala Delgado
(74) *Attorney, Agent, or Firm* — The Rapacke Law Group, P.A

(57) ABSTRACT

The invention is an anti-theft covering system that can surround an object and make cutting that object inefficient and time consuming. Using flexible, durable, high-heat resistant outer covering and hardened, stranded, metal cabling segments, oriented parallel to one another, and inside the outer covering, the invention makes cutting through it and whatever it covers both inefficient and time consuming.

21 Claims, 7 Drawing Sheets

Exploded view

Side view

End View

*For Every 10 Searches, There Is on Average one Reported Catalytic Converter Theft: Search/10.

ANTI-THEFT COVERING SYSTEM FOR CATALYTIC CONVERTERS

TECHNICAL FIELD

The invention is an anti-theft covering system for automotive catalytic converters.

BACKGROUND

Catalytic converters reduce the output of pollution-related exhaust gases by breaking down harmful compounds into benign simpler compounds. The catalysis reactions use platinum, palladium and rhodium—rare earth metals—to catalyze the chemical breakdown reactions.

Platinum, palladium and rhodium are all valuable elements, and though only a small amount of each is found inside a catalytic converter, they can drive the price of a stolen converter to $1,000 or more.

Catalytic converters are installed in the exhaust piping between the engine exhaust manifold and the muffler and tailpipe. As such, they are readily accessible from underneath a vehicle.

Stealing of catalytic converters has risen dramatically because someone can quickly scoot underneath a vehicle and using a portable, reciprocating-blade saw tool, cut through the piping on both sides of a converter and make off with it in a few minutes time. Each stolen catalytic converter is likely to be illegally sold for hundreds of dollars. That makes the few minutes of time to steal them a limited risk versus and a large reward.

From a thief's perspective, a reciprocating saw is capable of cutting through the exhaust piping and stealing the converter a relatively low-risk crime. From a vehicle owner's perspective, a stolen catalytic converter costs several hundreds of dollars to replace, and prior to replacement, exhaust gases are emitted from the cut end of the exhaust pipe, creating both added pollution and noise pollution.

SUMMARY OF THE INVENTION SYSTEM

The invention system herein disclosed is a covering system focused on making it both difficult and time consuming to cut through it with a reciprocating-blade saw. By increasing the time for removal from a few minutes to many more minutes, and forcing the replacement of damaged blades during the process, the invention system can protect against theft of the catalytic converter. As with most cases of opportunistic thievery, a thief will, given a choice, pick an unprotected target rather than a protected one. Thus, the covering system could dissuade an attempt to steal the catalytic converter.

Reciprocating-blade saws make use of hardened blades that can cut through even steel piping at a fast rate, but the cutting is predicated on the item being cut being essentially fixed in place. If the item moves back and forth with blade motion, the cutting becomes time consuming and inefficient.

The anti-theft covering for catalytic converters is designed such that it is both hard to cut due to the material hardness properties of its components, and at least one of the internal metal layer components is free to move along with the blade's motion. As a result, it takes far longer to make the cut, and often, it takes two or more blades because the cover's motion accelerates blade wear, too.

DETAILED DESCRIPTION

Catalytic converters were first used in 1975 model-year vehicles, in the United States, as a means of breaking down toxic exhaust chemicals into water, nitrogen and carbon dioxide. The chemical reduction inside a catalytic converter converts nitrogen oxide molecules into nitrogen and oxygen; carbon monoxide into carbon dioxide; and oxidation of hydrocarbons into carbon dioxide and water. The catalyst in the chemical process is a mixture of platinum, palladium and rhodium.

Platinum, palladium and rhodium are rare earth metals having high value and commensurately high prices. Although a catalytic converter uses a small quantity of such rare earth metals, there are enough to cause the price of a stolen converter to be as high as $1,000.

Catalytic converters are installed along the exhaust-system piping such that exhaust gases emerging from the engines exhaust manifold will travel through the piping and ultimately exit via the tail pipe. The catalytic converter is located between the exhaust manifold and muffler, and is readily accessible from underneath the vehicle. Under normal service conditions, the catalytic converter is removed by loosening clamps on each end, loosening the exhaust piping on the tail end, and maneuvering the catalytic converter until it is free of its exhaust-pipe insertions, or simply cutting the exhaust pipe using shop tools. This is a process that is typically done with the automobile on a lift, and can take many minutes and a collection of tools to accomplish.

In contrast, theft of catalytic converters is typically done with the vehicle on the ground by scooting underneath, and cutting through the exhaust piping on each end of the converter using a reciprocating-blade saw tool. Experienced thieves can get under, make the cuts, and remove a converter in just a few minutes. For them, the risk of being caught is outweighed by the speed and value of the stolen converter. These thefts are primarily done in darkness adding less chance of being seen and apprehended.

It is safe to say that each automobile model has a unique exhaust system wherein the placement of the catalytic converters will vary. In the case of compact vehicles, catalytic converters and exhaust piping is located closer to the lower vehicle chassis than in larger vehicles.

Figure 1:
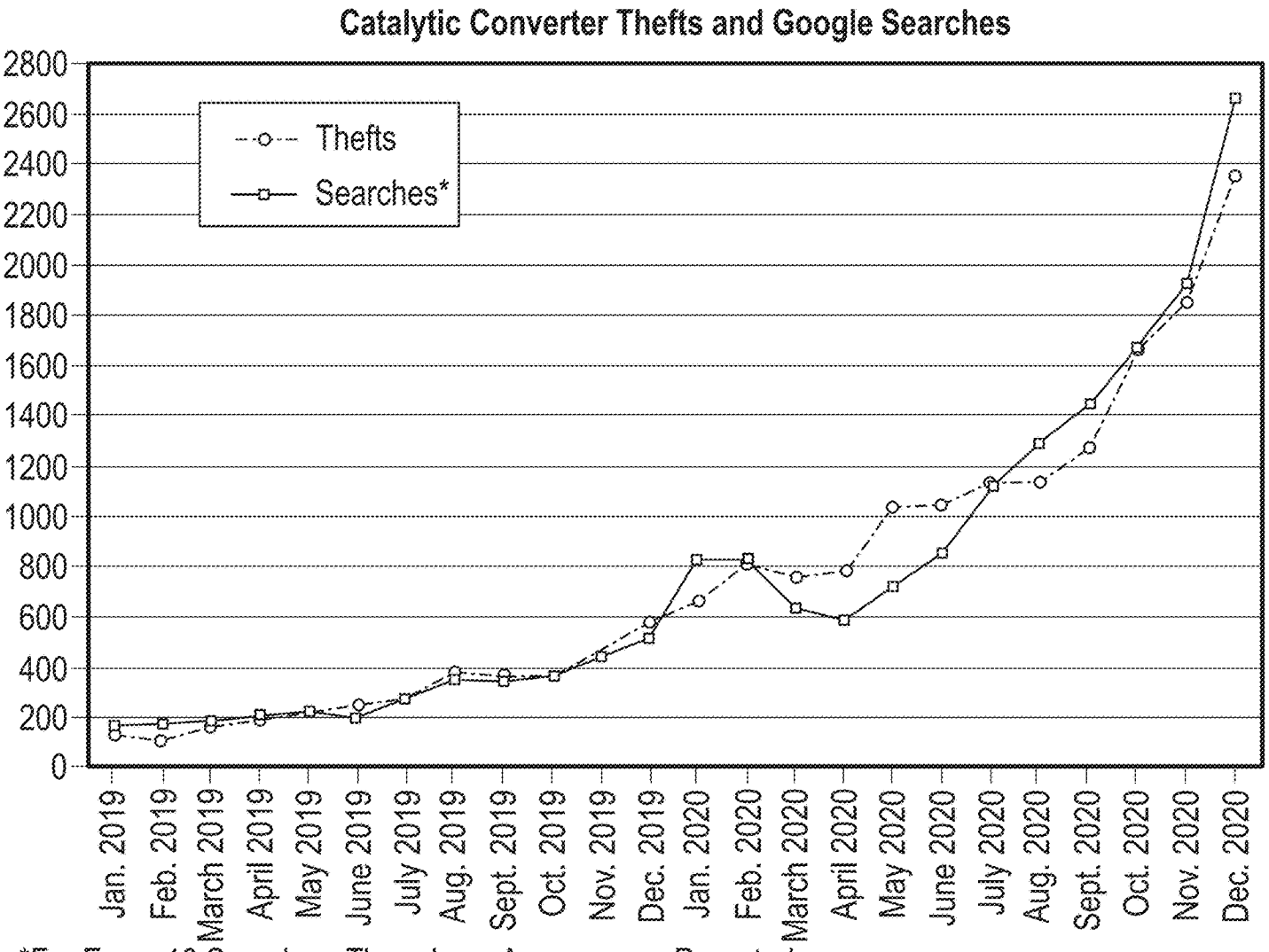
FIG. 1 shows a sharp increase in catalytic converter thefts.

Automobile makers could make it more difficult to cut and remove a catalytic converter but cost-versus-demand appears not to be compelling. Thus, car owners are on their own when it comes to converter theft. And, as shown in FIG. 1, theft of catalytic converters has been on a relentless uphill trend since first introduced in 1975.

With regard to catalytic-converter-theft deterrence, a vehicle parked in an owner's locked garage is perhaps the best deterrent. Parking a vehicle on a public street, some distance from the owner's location, where traffic is light and infrequent, is often an invitation to stealthy theft of a converter.

Most vehicle owners will at various times find themselves in a position of having to park the vehicle in a way that increases the likelihood of converter theft. Therefore, an anti-theft device that can deter theft would be of great utility.

Such an anti-theft device would have to accommodate a variety of vehicle models, different catalytic converter shapes and sizes, and be relatively easy to install while difficult to remove.

A solid-metal covering of some kind that encases a converter and is attached to the lower chassis would offer some deterrence, but, like the exhaust piping itself, the metal covering is susceptible to quick cutting using a reciprocating-blade saw tool. In addition, each such covering would have to be customized to size and shape based on vehicle type, model year, and so on.

The invention herein disclosed is intended to be usable on a variety of vehicle models and catalytic converter sizes and shapes. It is also designed to enable easy attachment even in cases where the converter and piping are close to the lower chassis of the vehicle.

The anti-theft covering system comprises a top, outer cover made of flexible, heat-resistant material; a first flexible metal layer adjacent to the top, outer cover; a second flexible metal layer of same or different material properties and dimensions below the first metal layer; a third metal layer below the second metal layer, and a bottom, outer cover made of heat-resistant material with a heat-activated adhesive material on its outer surface. The covers and metal layers comprise a strap shaped system that can conform to the size and shape of a catalytic converter and its connecting exhaust pipe interfacing. By strapping the covering to the converter and its input and output exhaust pipe interfacing, then clamping the ends with a suitable clamping device, both the converter and its adjacent exhaust piping are protected from being cut through by a reciprocating-blade saw tool.

When so covered, the vulnerable input-output piping interfaces are no longer exposed to a reciprocating-blade saw tool's blade. To cut the piping requires cutting through the covering, first. And, if the outer cover is both durable and flexible, and if at least one of the inner, hardened, metal layers is free to move laterally or in any coordinate parallel to the cutting blade, then a reciprocating-blade saw tool's blade will not have a fixed-in-place target, such as the exhaust piping, but, rather, a movable cover and inner elements that can move in step with the blade. As such, the cutting would be both time consuming and inefficient. Testing has shown that often two or more blades must be used, in succession, before a cutting of the exhaust pipe can be done.

As a result of the added time and cutting difficulty, the anti-theft covering system can act as a strong deterrent to converter theft regardless of where a vehicle is parked. And, because of its readily identifiable presence, a thief may back off from attempting to steal the converter and look for another vehicle with an unprotected converter, instead.

To more fully explain the structure and function of the invention as well as its installation, the following disclosures are included.

Figure 2:
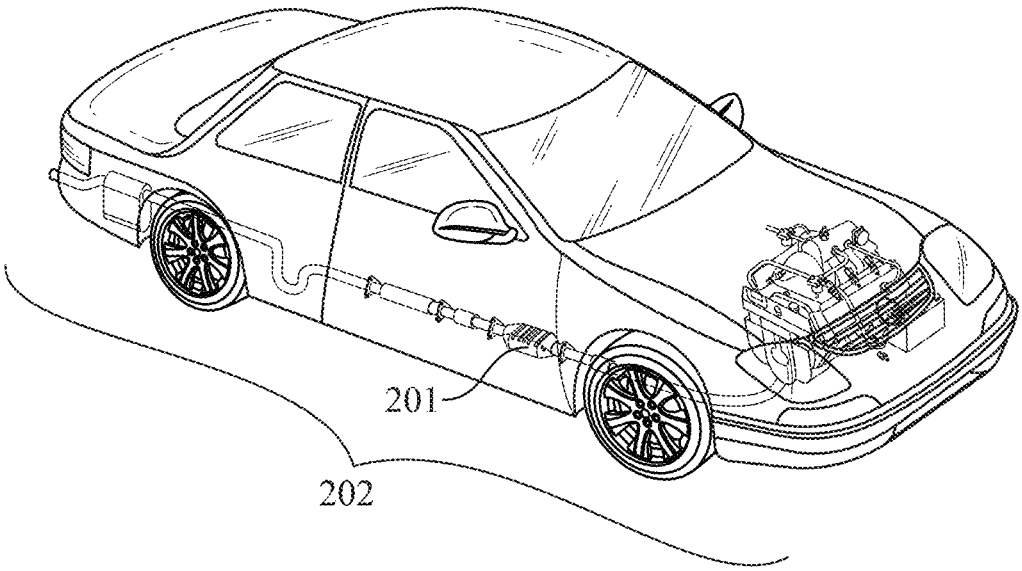
FIG. 2 is an exemplary depiction of a catalytic converter and its location vis-à-vis an automobile's exhaust system.

In FIG. 2, we see a generic automobile depicted with its exhaust system shown and the location of a catalytic converter, 201, located aft of the exhaust manifold (e.g. the portion that interfaces with the engine) and before the muffler and tail pipe.

Figure 3:
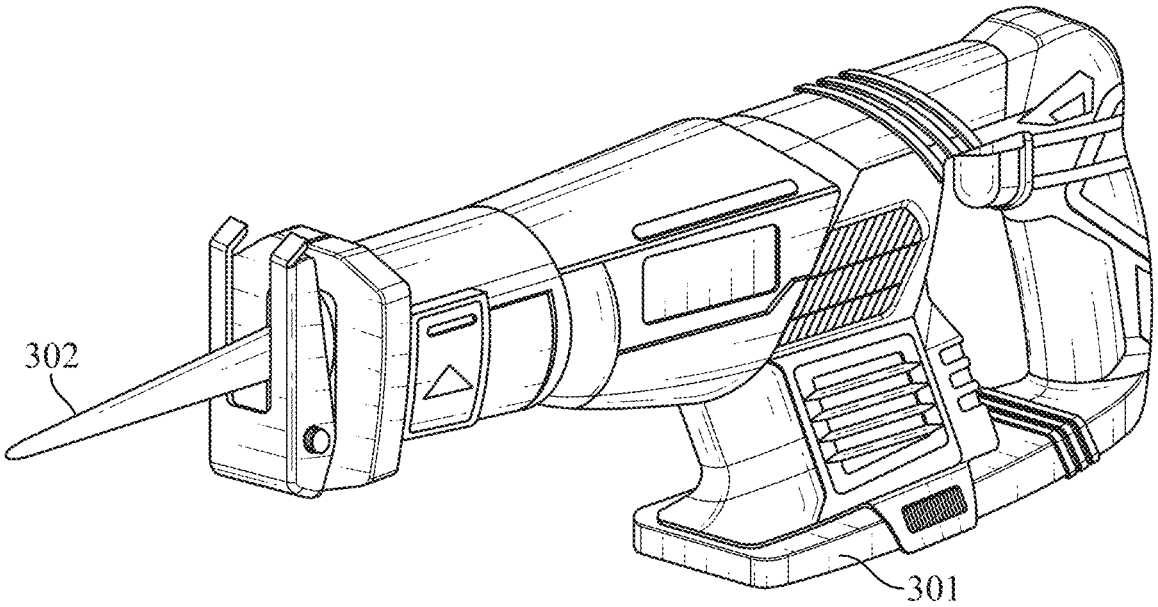
FIG. 3 shows a reciprocating-blade sawing tool which is the tool of choice for catalytic converter theft.

The tool of choice for catalytic-converter theft is a reciprocating-blade saw tool such as the one shown in FIG. 3, 301, and it blade, 302.

Figure 4:
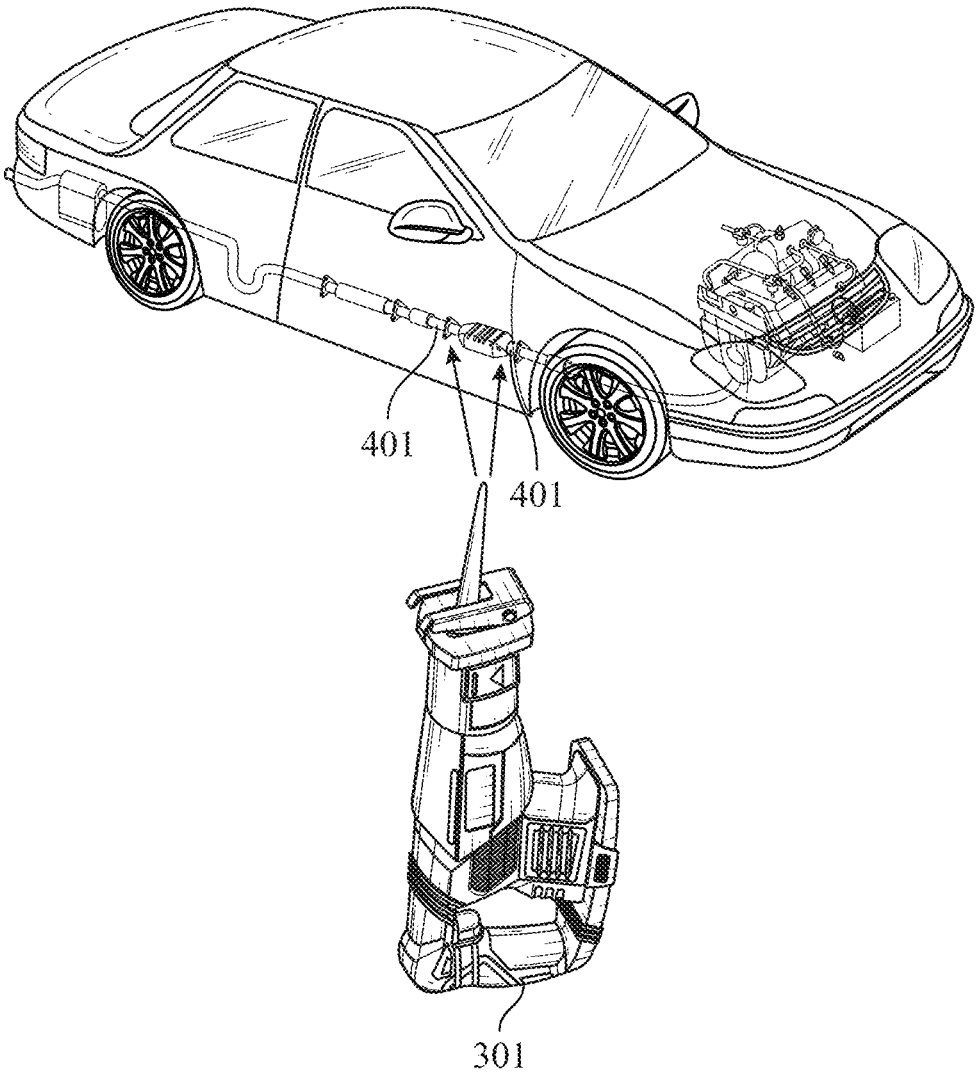
FIG. 4 depicts the points on an exemplary exhaust system in which a reciprocating-blade saw tool would be deployed to cut loose the catalytic converter.

As shown in FIG. 4, the tool, 301, is used to cut through the exhaust pipe on both ends of the catalytic converter, 401. Despite the exhaust pipe's gauge and hardness, the tool, 301, will typically cut through each piping interface in a minute or less. Thus, from the time a thief first scoots under the vehicle, makes the cuts, and makes off with the converter, only a few minutes may have elapsed.

Figure 5:
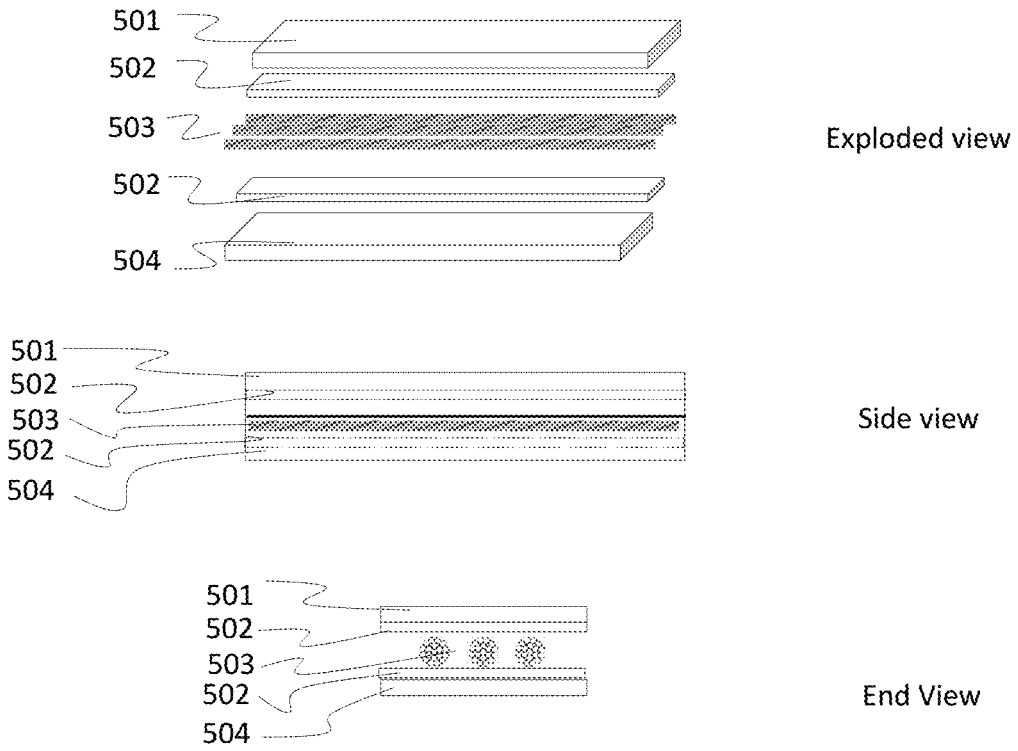
FIG. 5 shows an exploded view, side view and edge view of an exemplary implementation of the invention system.

FIG. 5 shows an exploded view, side view and end view of the invention system. The bottom, outer cover, 501, is made of flexible, durable, heat-resistant material. This would be the surface of the system that faces away from the converter and piping interface. Adjacent to the bottom, outer cover is a flexible sheet of metal material 502. Adjacent to the first metal material layer is a second layer of unfixed metal, 503, that is free to move laterally and/or vertically independent of one another. Adjacent to the second metal layer is another flexible sheet of metal material 502. And, completing the system is a top, cover of heat-resistant material 504. The metal layer portions, 503, are meant to be oriented in parallel with the covered pipe and its catalytic converter.

Because of the flexibility of the top and bottom, outer covering material, and the lateral flexibility of the metal layers, the covering system may easily conform to size and shape of the catalytic converter to be covered.

Figure 6:
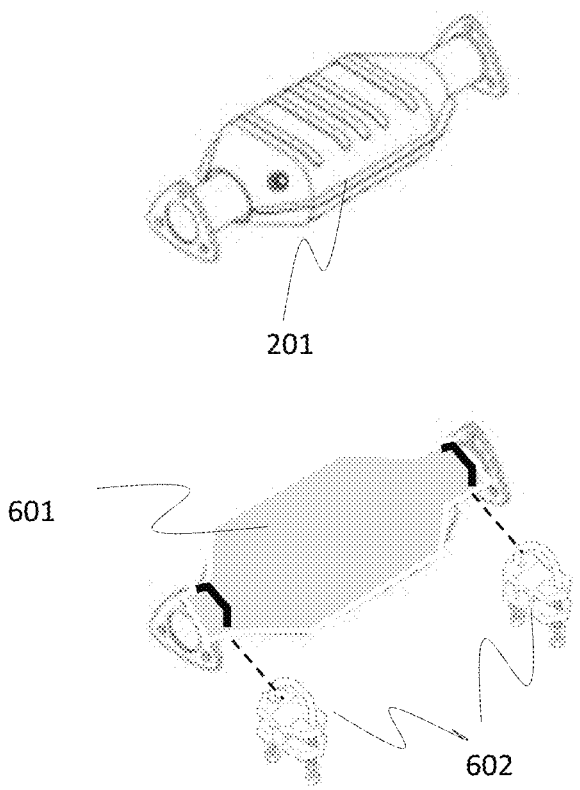
FIG. 6 depicts an uncovered catalytic converter and the same converter with the anti-theft covering system deployed so as to protect it from being cut loose.

As shown in FIG. 6, an uncovered converter, 201, is then wrapped with the covering invention, 601, such that the converter and exhaust pipe interfaces are covered and protected. The covering is then secured by a clamping device, 602. The device shown is a generic U-bolt. The saddle may be shaped so as to present a difficult-to-saw surface, and it may be made of hardened steel material. Alternatively, an auxiliary, smaller, mounting strap fixture, with cables inside that are transverse to the pipe, may be used wherein a blade held parallel to the exhaust pipe so as to cut the auxiliary strapping fixture would be reduced to time consuming, inefficient cutting due to the cable and material motion of the smaller mounting strap.

Figure 7:
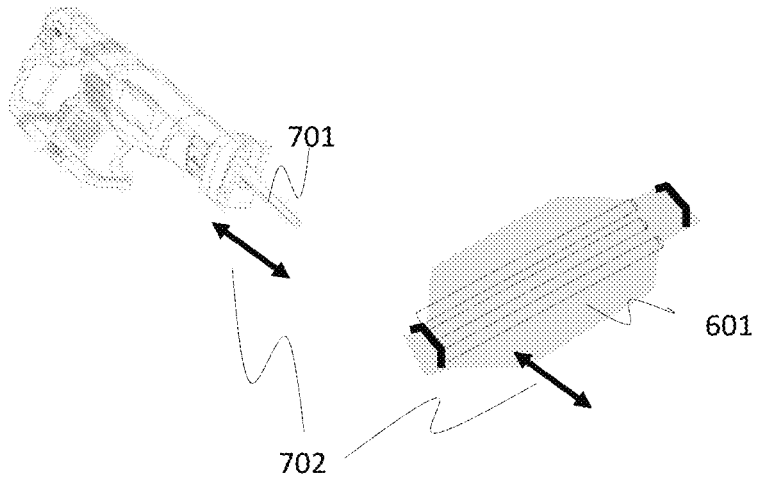
FIG. 7 depicts how the reciprocating blade's back-and-forth motion causes a sympathetic back-and-forth motion of the inventions outer material and inner metal elements.

As shown in FIG. 7, the wrapped converter, 601, when a reciprocating-blade saw tool is applied, 701, will react such that both the bottom, outer covering material and inner metal layer portions are free to move back-and-forth in sympathetic motion with the tool's blade, 702. As such, the cutting force is blunted, making the tool inefficient, and the blade may be damaged such that it must be replaced at least once before a successfully cut can be made.

Clearly, with covering in place, it will take far longer to successfully cut the pipe and remove the catalytic converter. Fast cutting is a prime criterion for reducing the risk of apprehension, so a thief would view the covering system as a strong deterrent to moving forward. As a result, the vehicle owner is more likely to be spared the loss and cost of a stolen catalytic converter.

Note that the material used in the outer coverings and the inner cable portions may be made of existing materials so long as they are sufficiently durable, heat-resistant, and flexible.

The outer covering could be fabric-like using fibers such as para-aramid fibers; fiberglass yarns coated with polytetrafluoroethylene; basalt fibers; silicate fibers; ceramic fibers; and zirconium fibers. It may also be made of silicone rubber; or hydrogenated acrylonitrile-butadiene rubber; or ethylene propylene diene monomer-based rubber. Other similar materials may also be used for outer coverings.

The inner metal layers may use materials associated with aircraft control cables, such as galvanized steel stands, stainless-steel strands, or hardened steel strips of varying dimensions. There are tradeoffs with regard to the number of strands and the gauge of strands. The greater number of strands and larger-gauge strands will resist cutting more than fewer, lower-gauge strands, but they will be less flexible and more resistant to sympathetic lateral motion than the smaller-gauge, fewer strand cables.

The auxillary, smaller, strapping optionally used to secure the covering to the catalytic converter and exhaust pipe is meant to be easy to install (e.g. flexible) yet will have outer covering as well as cable portions that are transverse to those that are parallel to the exhaust pipe. That helps deter an attempt to cut through the strapping as a way to remove the covering system. It will also deter an attempt to cut the covering using the blade parallel to cable portion orientation, since doing so would put the blade transverse to the cables in the strapping subsystem.

Note that all drawings arm meant to be exemplary and should not be read as limiting the scope and implementation of the invention.

What is claimed is:

1. An anti-theft covering system comprising:

a flexible, heat-resistant top outer covering which faces a covered item;

a flexible heat resistant bottom outer covering which faces away from the covered item; and more than one hardened, metal layer segments contained within the top and bottom outer covering and oriented parallel to one another, wherein adjacent to a first metal layer segment is a second metal layer segment, the first metal layer segment and the second metal layer segment are configured to move laterally and vertically independent of each other in a plane parallel to a cutting blade.

2. A claim as in claim 1 wherein:

the flexible, heat-resistant top and bottom outer covering are made of para-aramid fibers.

3. A claim as in claim 1 wherein:

the flexible, heat-resistant top and bottom outer covering are made of fiberglass yarns coated with polytetrafluoroethylene.

4. A claim as in claim 1 wherein:

the flexible, heat-resistant top and bottom outer covering are made of basalt fibers.

5. A claim as in claim 1 wherein:

the flexible, heat-resistant top and bottom outer covering are made of silicate fibers.

6. A claim as in claim 1 wherein:

the flexible, heat-resistant top and bottom outer covering are made of ceramic fibers.

7. A claim as in claim 1 wherein:

the flexible, heat-resistant top and bottom outer covering are made of zirconium fibers.

8. A claim as in claim 1 wherein:

the flexible, heat resistant top and bottom outer covering are made of silicone rubber.

9. A claim as in claim 1 wherein:

the flexible, heat resistant top and bottom outer covering are made of hydrogenated acrylonitrile-butadiene rubber.

10. A claim as in claim 1 wherein:

the flexible, heat resistant top and bottom outer covering are made of ethylene propylene diene monomer-based rubber.

11. A claim as in claim 1 wherein:

an auxiliary strapping mounting fixture is made of para-aramid fibers, the auxiliary strapping mounting fixture comprising cables transversing an exhaust pipe.

12. A claim as in claim 1 wherein:

an auxiliary strapping fixture is made of fiberglass yarns coated with polytetrafluoroethylene.

13. A claim as in claim 1 wherein:

the auxiliary strapping mounting fixture is made of made of basalt fibers.

14. A claim as in claim 1 wherein:

the auxiliary strapping fixture is made of made of silicate fibers.

15. A claim as in claim 1 wherein:

the auxiliary strapping mounting fixture is made of made of ceramic fibers.

16. A claim as in claim 1 wherein:

the auxiliary strapping fixture is made of zirconium fibers.

17. A claim as in claim 1 wherein:

the auxiliary strapping mounting fixture is made of silicone rubber.

18. A claim as in claim 1 wherein:

the auxiliary strapping mounting fixture is made of hydrogenated acrylonitrile-butadiene rubber.

19. A claim as in claim 1 wherein:

the auxiliary strapping mounting fixture is made of ethylene propylene diene monomer-based rubber.

20. A claim as in claim 1 wherein:

the more than one hardened, metal layer segments are made of steel.

21. A claim as in claim 1 further comprising:

a heat-activated adhesive material on the outer surface of the bottom outer covering which creates a bond between the covering system and the exhaust pipe and/or catalytic converter.

* * * * *